US006050165A

United States Patent [19]

Hall

[11] Patent Number: 6,050,165

[45] Date of Patent: Apr. 18, 2000

[54] RATCHET BOX WRENCH

[76] Inventor: Charles E Hall, 1278 Mariposa Dr. Northeast, Palm Bay, Fla. 32905

[21] Appl. No.: 09/157,843

[22] Filed: Sep. 21, 1998

[51] Int. Cl.[7] ..... B25B 13/46

[52] U.S. Cl. ..... 83/63.1; 81/59.1; 81/58.2

[58] Field of Search ..... 81/59.1–63.2, 81/58.1, 58.4, 57.1–57.45

[56] References Cited

U.S. PATENT DOCUMENTS

| | | | |
|---|---|---|---|
| 4,362,072 | 12/1982 | Tillman | 81/57.29 |
| 4,592,255 | 6/1986 | Mayer | 81/62 |
| 4,722,252 | 2/1988 | Fulcher et al. | 81/57.39 |
| 4,974,475 | 12/1990 | Lord et al. | 81/57.29 |
| 5,603,247 | 2/1997 | Wei | 81/63 |
| 5,626,062 | 5/1997 | Colvin | 81/63.2 |
| 5,794,496 | 8/1998 | Arnold | 81/60 |

*Primary Examiner*—David A. Scherbel
*Assistant Examiner*—Lee Wilson
*Attorney, Agent, or Firm*—Michael I. Kroll

[57] ABSTRACT

A ratchet box wrench (10) comprising an elongate handle (12). A main housing (14) is at one end of the elongate handle (12). The main housing (14) has a circular cavity (16) therein with a seat (18) and a central aperture (20) therethrough. A geared socket (22) has a central collar (24) with a multiple faced opening (26) extending therethrough. A structure (28) is for rotatably carrying the geared socket (22) within the circular cavity (16) on the seat (18), so that the central collar (24) will extend through the central aperture (20) in the main housing (14). A rotational adjustment lever (30) is on one end of the elongate handle (12) adjacent to the main housing (14) to reverse rotation of the geared socket (22), whereby the multiple faced opening (26) in the geared socket (22) will engage with a multiple faced object, which will be turned by movement of the elongate handle (12).

18 Claims, 5 Drawing Sheets

RATCHET BOX WRENCH

BACKGROUND OF THE INVENTION

1. Field of the Invention

The instant invention relates generally to wrenches and more specifically it relates to a ratchet box wrench. The ratchet wrench contains a geared socket having a multiple faced opening, rotatably carried within a main housing at an end of a handle, so as to engage with a corresponding multiple faced object, such as a bolt head or nut. The geared socket is removable from the main housing, so that it can be replaced with another geared socket having a different multiple faced opening, to engage with a corresponding multiple faced object.

2. Description of the Prior Art

Numerous wrenches have been provided in prior art that are hand held tools for gripping, turning or twisting objects such as nuts, bolts or pipes. While these units may be suitable for the particular purpose to which they address, they would not be as suitable for the purposes of the present invention as heretofore described.

SUMMARY OF THE INVENTION

A primary object of the present invention is to provide a ratchet box wrench that will overcome the shortcomings of the prior art devices.

Another object is to provide a ratchet box wrench that contains a geared socket having a multiple faced opening, rotatably carried within a main housing at an end of a handle, so as to engage with a corresponding multiple faced object, such as a bolt head or nut.

An additional object is to provide a ratchet box wrench, in which the geared socket is removable from the main housing, so that it can be replaced with another geared socket having a different multiple faced opening, to engage with a corresponding multiple faced object.

A further object is to provide a ratchet box wrench that is simple and easy to use.

A still further object is to provide a ratchet box wrench that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
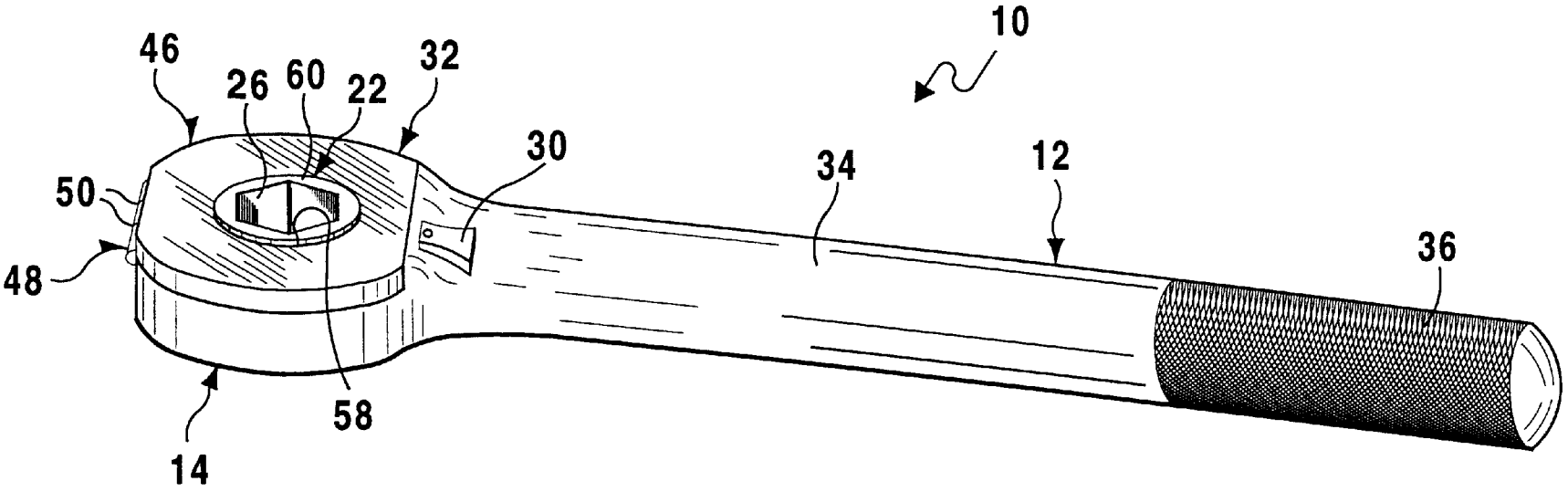
FIG. 1 is a perspective view of the present invention.
Figure 2:
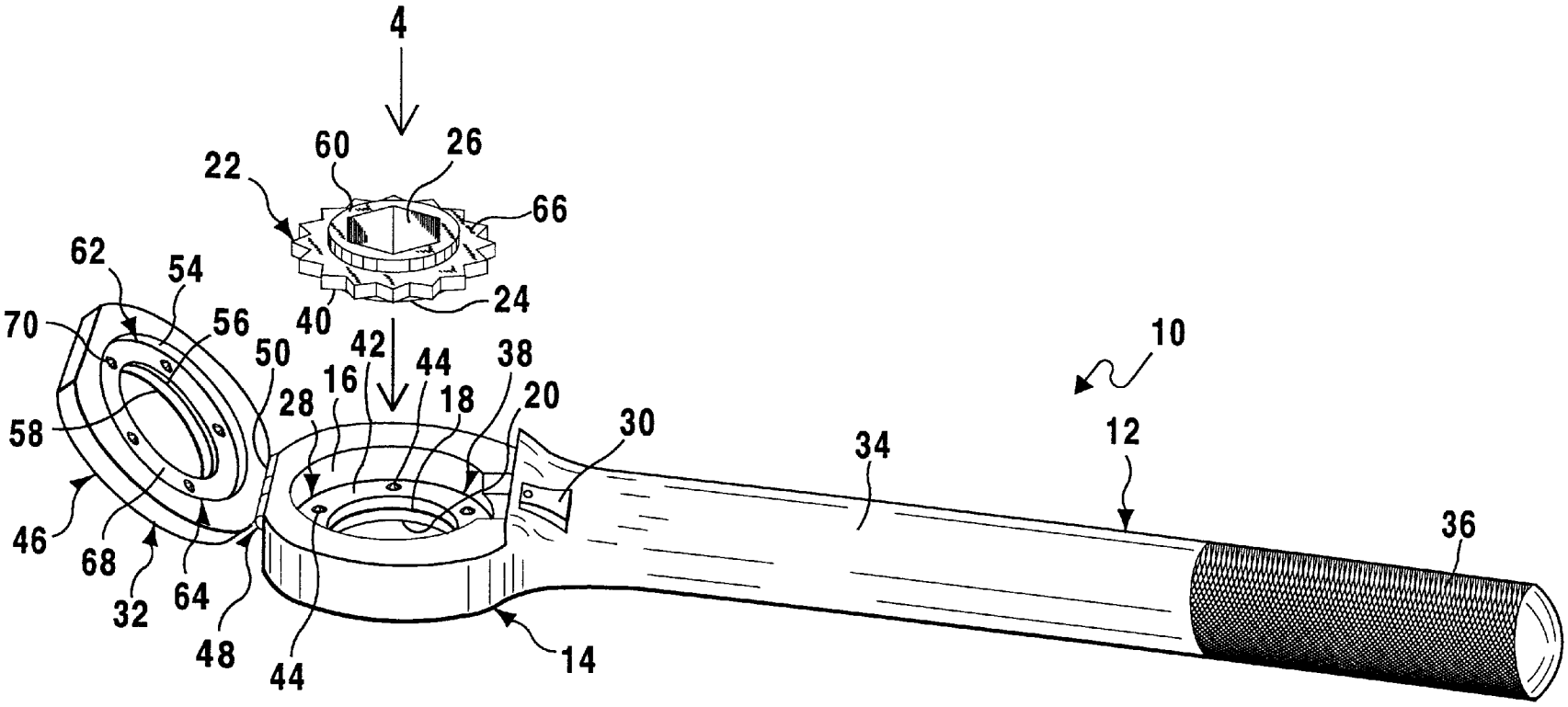
FIG. 2 is a perspective view of the present invention with the cover plate opened and the geared socket ready to be inserted within the cavity of the main housing.
Figure 3:
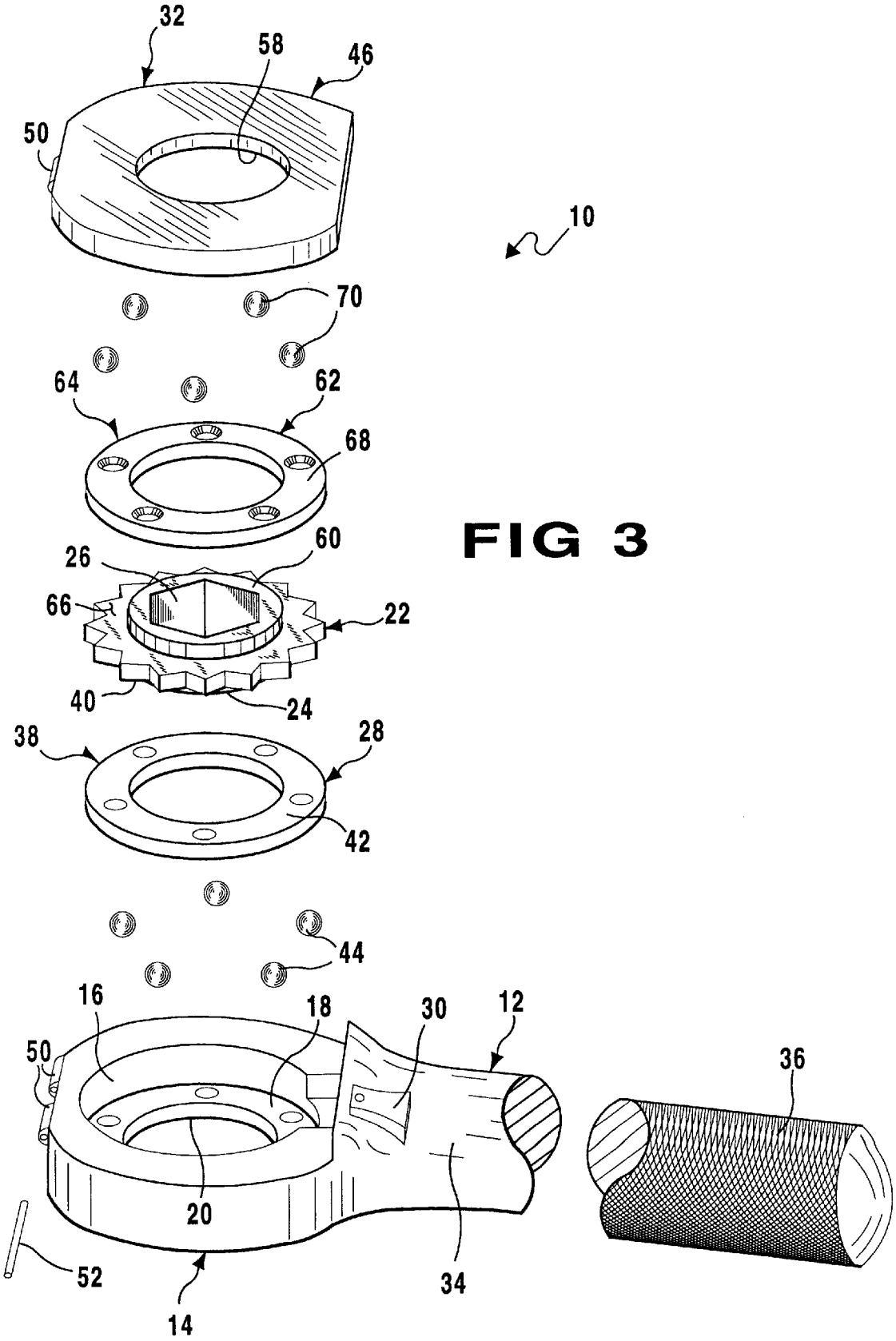
FIG. 3 is an exploded perspective view of the present invention, showing the various components thereof with the handle broken away.

Turning now descriptively to the drawings, in which similar reference characters denote similar elements through out the several views, FIGS. 1 through 3 illustrate the present invention being a ratchet box wrench. With regard to the reference numerals used, the following numbering is used throughout the various drawing figures.

10 ratchet box wrench
12 elongate handle of 10
14 main housing of 10
16 circular cavity in 14
18 seat of 16
20 central aperture in 14
22 geared socket of 10
22*a* geared socket of 10
22*b* geared socket of 10
first central collar of 22
large sized multiple faced opening in 22
26*a* small sized multiple faced opening in 22*a*
26*b* medium sized multiple faced opening in 22*b*
28 first rotatable carrying structure of 10
30 rotational adjustment lever of 10
32 removal allowing assembly of 10
34 cylindrical member for 12
36 knurled surface on 34
38 first ball bearing raceway for 28
40 bottom surface of 22
42 first bearing retainer ring of 38
44 ball of 38
46 cover plate of 32
48 hinge of 32 between 46 and 14
50 barrel of 48
52 pivot pin of 48
54 circular cavity in 46
56 seat of 54
58 central aperture in 46
60 second central collar of 22
62 second rotatable carrying structure of 10
64 second ball bearing raceway for 62
66 top surface of 22
68 second bearing retainer ring of 64
70 ball of 64

Figure 4:
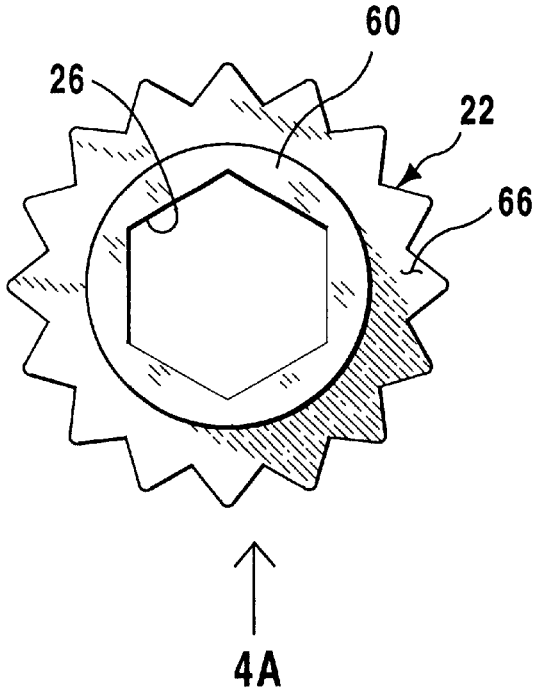
FIG. 4 is an enlarged top plan view of the geared socket taken in the direction of arrow 4 in FIG. 2, having a large sized multiple faced opening therein.
Figure 4A:
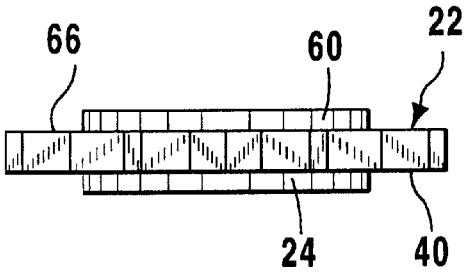
FIG. 4A is a front elevational view of the geared socket taken in the direction of arrow 4A in FIG. 4.
Figure 4B:
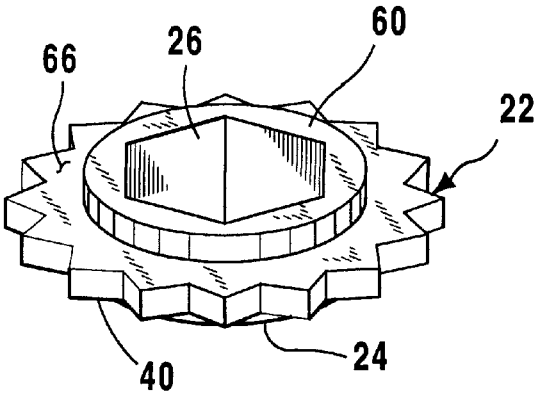
FIG. 4B is a perspective view of the geared socket shown in FIG. 4.

The ratchet box wrench 10 comprises an elongate handle 12. A main housing 14 is at one end of the elongate handle 12. The main housing 14 has a circular cavity 16 therein with a seat 18 and a central aperture 20 therethrough. A geared socket 22 has a central collar 24 with a multiple faced opening 26 extending therethrough (see FIGS. 4, 4A and 4B The multiple faced opening 26 in the geared socket 22 is large sized.

The structure 28 is for rotatably carrying the geared socket 22 within the circular cavity 16 on the seat 18, so that the central collar 24 will extend through the central aperture 20 in the main housing 14. A rotational adjustment lever 30 is on one end of the elongate handle 12 adjacent to the main housing 14 to reverse rotation of the geared socket 22, whereby the multiple faced opening 26 in the geared socket 22 will engage with a multiple faced object (not shown), such as a bolt head or nut, which will be turned by movement of the elongate handle 12.

Figure 5:
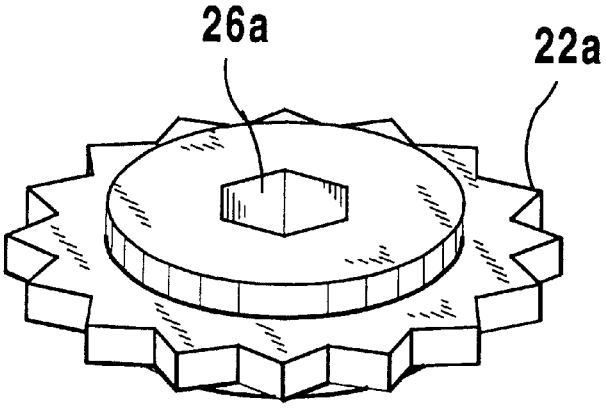
FIG. 5 is a perspective view of a geared socket similar to FIG. 4B, having a small sized multiple faced opening therein.
Figure 6:
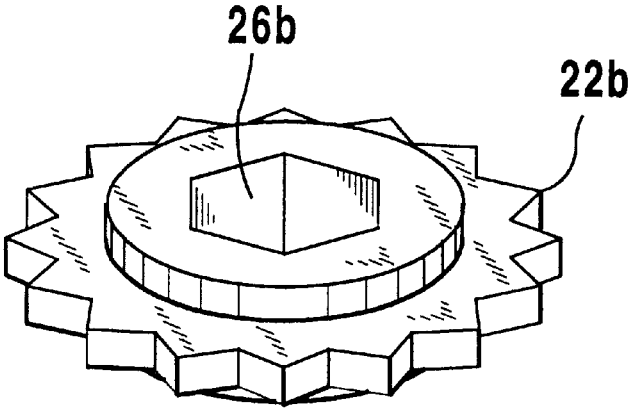
FIG. 6 is a perspective view of a geared socket similar to FIG. 5, having a medium sized multiple faced opening therein.

An assembly 32 is for allowing the geared socket 22 to be removed from the circular cavity 16 of the main housing so that it can be replaced with another geared socket 22*a*, 22*b*, having a different multiple faced opening 26*a*, 26*b* therethrough, to engage with a corresponding multiple faced object (see FIGS. 5 and 6). The multiple faced opening 26*a* in the geared socket 22*a* in FIG. 5 is small sized, while the multiple faced opening 26*b* in the geared socket 22*b* in FIG. 6 is medium sized.

The elongate handle 12 is a cylindrical member 34 having a knurled surface 36 at an opposite end from the main housing 14, so as to aid in gripping the cylindrical member 34 by a hand of a person. The main housing 14 is integral with the elongate handle 12. The multiple faced opening 26 in the geared socket 22 can be a hexagonal cavity to engage with a hexagonal object. Other polygonal cavities can also be incorporated in the geared socket 22, as the multiple faced opening 26.

The rotatable carrying structure 28 includes a ball bearing raceway 38 press fitted onto the seat 18 of the circular cavity 16 in the main housing 14, so that a bottom surface 40 of the geared socket 22 about the central collar 24 can rotate there against. The ball bearing raceway 38 consists of a bearing retainer ring 42 and a plurality of balls 44 rotatably mounted through the bearing retainer ring 42.

The removal allowing assembly 32 includes a cover plate 46 and a hinge 48 between one side of the cover plate 46 and the main housing 14 opposite from the elongate handle 12. When the cover plate 46 is opened, the geared socket 22 can be removed therefrom. The hinge 48 contains a plurality of barrels 50. At least one barrel 50 is connected to the cover plate 46, while at least two barrels 50 are connected to the main housing 14 between the at least one barrel 50 on the cover plate 46. A pivot pin 52 extends through the barrels 50, to allow the cover plate 46 to pivot away from the main housing 14.

The cover plate 46 has a circular cavity 54 on the bottom with a seat 56 and a central aperture 58 therethrough. The geared socket 22 has a second central collar 60 with the multiple faced opening 26 extending therethrough. A second structure 62 is for rotatably carrying the geared socket 22 within the circular cavity 54 on the seat 56 below the cover plate 46 when closed. The second central collar 60 will extend through the central aperture 58 in the cover plate 46, whereby the multiple faced opening 26 in the geared socket 22 can engage with the multiple faced object from either side of the geared socket 22.

The second rotatable carrying structure 62 includes a second ball bearing raceway 64 press fitted onto the seat 56 of the circular cavity 54 in the cover plate 46, so that a top surface 66 of the geared socket 22 about the second central collar 60 can rotate there against. The second ball bearing raceway 64 consists of a second bearing retainer ring 68 and a plurality of balls 70 rotatably mounted through the second bearing retainer ring 68.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A ratchet box wrench comprising:

a) an elongate handle;

b) a main housing at one end of said elongate handle, said main housing having a circular cavity therein with a seat and a central aperture therethrough, c) a geared socket having a central collar with a multiple faced opening extending therethrough;

d) means for rotatably carrying said geared socket within the circular cavity on the seat, so that the central collar will extend through the central aperture in said main housing; and e) a rotational adjustment lever on one end of said elongate handle adjacent to said main housing to reverse rotation of said geared socket, whereby the multiple faced opening in said geared socket will engage with a multiple faced object, which will be turned by movement of said elongate handle, said ratchet box further comprising:

f) means for allowing said geared socket to be removed from the circular cavity of said main housing, so that it can be replaced with another seared socket having a different multiple faced opening therethrough to engage with a corresponding multiple faced object, said allowing means including:

i) a cover plate; and ii) a hinge between one side of said cover plate and said main housing opposite from said elongate handle, so that when said cover plate is opened said geared socket can be removed therefrom.

2. A ratchet box wrench as recited in claim 1, wherein said hinge includes:

a) a plurality of barrels, in which at least one said barrel is connected to said cover plate, while at least two said barrels are connected to said main housing between said at least one said barrel on said cover plate; and b) a pivot pin which extends through said barrels, to allow said cover plate to pivot away from said main housing.

3. A ratchet box wrench as recited in claim 1, further including:

a) said cover plate having a circular cavity on the bottom with a seat and a central aperture therethrough;

b) said geared socket having a second central collar with the multiple faced opening extending therethrough; and c) means for rotatably carrying said geared socket within the circular cavity on the seat below said cover plate when closed, so that the second central collar will extend through the central aperture in said cover plate, whereby the multiple faced opening in said geared socket can engage with the multiple faced object from either side of said geared socket.

4. A ratchet box wrench as recited in claim 3, wherein said second rotatably carrying means includes a second ball bearing raceway press fitted onto the seat of the circular cavity 54 in said cover plate and a top surface of said geared socket about the second central collar can rotate there against.

5. A ratchet box wrench as recited in claim 4, wherein said second ball bearing raceway includes:

a) a second bearing retainer ring; and b) a plurality of balls rotatably mounted through said second bearing retainer ring.

6. A ratchet box wrench as recited in claim 1, wherein said elongate handle is a cylindrical member having a knurled surface at an opposite end from said main housing, so as to aid in gripping said cylindrical member by a hand of a person.

7. A ratchet box wrench as recited in claim 6, wherein said main housing is integral with said elongate handle.

8. A ratchet box wrench as recited in claim 7, wherein the multiple faced opening in said geared socket is a hexagonal cavity to engage with a hexagonal object.

9. A ratchet box wrench as recited in claim 8, wherein said rotatable carrying means includes a ball bearing raceway press fitted onto the seat of the circular cavity in said main housing, so that a bottom surface of said geared socket about the central collar can rotate there against.

10. A ratchet box wrench as recited in claim 9, wherein said ball bearing raceway includes:

a) a bearing retainer ring; and b) a plurality of balls rotatably mounted through said bearing retainer ring.

11. A ratchet box wrench as recited in claim 10, wherein said hinge includes:

a) a plurality of barrels, in which at least one said barrel is connected to said cover plate, while at least two said barrels are connected to said main housing between said at least one said barrel on said cover plate; and b) a pivot pin which extends through said barrels, to allow said cover plate to pivot away from said main housing.

12. A ratchet box wrench as recited in claim 11, further including:

a) said cover plate having a circular cavity on the bottom with a seat and a central aperture therethrough;

b) said geared socket having a second central collar with the multiple faced opening extending therethrough; and c) means for rotatably carrying said geared socket within the circular cavity on the seat below said cover plate when closed, so that the second central collar will extend through the central aperture in said cover plate, whereby the multiple faced opening in said geared socket can engage with the multiple faced object from either side of said geared socket.

13. A ratchet box wrench as recited in claim 12, wherein said second rotatably carrying means includes a second ball bearing raceway press fitted onto the seat of the circular cavity 54 in said cover plate and a top surface of said geared socket about the second central collar can rotate there against.

14. A ratchet box wrench as recited in claim 13, wherein said second ball bearing raceway includes:

a) a second bearing retainer ring; and b) a plurality of balls rotatably mounted through said second bearing retainer ring.

15. A ratchet box wrench as recited in claim 1, wherein said main housing is integral with said elongate handle.

16. A ratchet box wrench as recited in claim 1, wherein the multiple faced opening in said geared socket is a hexagonal cavity to engage with a hexagonal object.

17. A ratchet box wrench as recited in claim 1, wherein said rotatable carrying means includes a ball bearing raceway press fitted onto the seat of the circular cavity in said main housing, so that a bottom surface of said geared socket about the central collar can rotate there against.

18. A ratchet box wrench as recited in claim 17, wherein said ball bearing raceway includes:

a) a bearing retainer ring; and b) a plurality of balls rotatably mounted through said bearing retainer ring.

* * * * *